US008806909B2

(12) United States Patent
Maierhofer

(10) Patent No.: US 8,806,909 B2
(45) Date of Patent: Aug. 19, 2014

(54) CONTROL METHOD FOR A ROLLING STAND FOR ROLLING A STRIP

(75) Inventor: Andreas Maierhofer, Marloffstein (DE)

(73) Assignee: Siemens Aktiengesellschaft, Munich (DE)

( * ) Notice: Subject to any disclaimer, the term of this patent is extended or adjusted under 35 U.S.C. 154(b) by 1412 days.

(21) Appl. No.: 12/521,322

(22) PCT Filed: Dec. 5, 2007

(86) PCT No.: PCT/EP2007/063369
§ 371 (c)(1),
(2), (4) Date: Jun. 26, 2009

(87) PCT Pub. No.: WO2008/083880
PCT Pub. Date: Jul. 17, 2008

(65) Prior Publication Data

US 2010/0000278 A1 Jan. 7, 2010

(30) Foreign Application Priority Data

Jan. 10, 2007 (DE) ..... 10 2007 001 539

(51) Int. Cl.
*B21B 37/48* (2006.01)
*G06F 19/00* (2011.01)

(52) U.S. Cl.
USPC ..... 72/8.6; 72/11.4; 72/12.3; 700/152

(58) Field of Classification Search
USPC ..... 72/8.7, 11.4, 8.6, 12.3, 12.4, 205; 700/146, 148, 150, 152
See application file for complete search history.

(56) References Cited

U.S. PATENT DOCUMENTS

| | | | | |
|---|---|---|---|---|
| 3,315,506 | A * | 4/1967 | Schneider | 72/8.7 |
| 4,335,439 | A * | 6/1982 | St. Denis | 700/150 |
| 4,570,472 | A | 2/1986 | Kuwano | B21B 39/16 |
| 7,031,797 | B2 * | 4/2006 | Reinschke et al. | 700/150 |
| 2002/0108423 | A1 * | 8/2002 | Nakayama et al. | 72/234 |

FOREIGN PATENT DOCUMENTS

| | | | | |
|---|---|---|---|---|
| DE | 3413269 | A1 | 10/1984 | B21B 37/30 |
| DE | 3413424 | A1 | 10/1984 | B21B 37/00 |
| DE | 102004043790 | | 3/2006 | B21B 31/16 |
| JP | 59127917 | A * | 7/1984 | B21B 37/00 |
| JP | 7124620 | A | 5/1995 | B21B 37/00 |
| SU | 1704871 | A1 | 1/1992 | B21B 37/00 |

OTHER PUBLICATIONS

German Office Action, German App. No. 102007001539.0-55, 6 pages, Aug. 3, 2007.
International Search Report, PCT/EP2007/063369, 11 pages, May 12, 2007.

* cited by examiner

*Primary Examiner* — Shelley Self
*Assistant Examiner* — Pradeep C Battula
(74) *Attorney, Agent, or Firm* — King & Spalding L.L.P.

(57) ABSTRACT

A strip has a left and a right side. The strip is rolled in a rolling stand. Stresses occurring in the strip at the feed and exit sides are detected by corresponding measuring sensors positioned on the left and right sides of the strip. The detected stresses are fed to a control unit for the rolling stand. The control unit determines a measurement for the transversal positioning of the strip in relation to the rolling stand using the relationship Z=ZLE*ZLA−ZRE−ZRA, where Z is the measurement. ZLE, ZLA, ZRE and ZRA are the individually detected stresses. The control unit determines a correcting variable for correcting the transversal positioning of the strip using the measurement for the transversal positioning and controls the rolling stand according to the correcting variable.

3 Claims, 2 Drawing Sheets

CONTROL METHOD FOR A ROLLING STAND FOR ROLLING A STRIP

CROSS-REFERENCE TO RELATED APPLICATIONS

This application is a U.S. National Stage Application of International Application No. PCT/EP2007/063369 filed Dec. 5, 2007, which designates the United States of America, and claims priority to German Application No. 10 2007 001 539.0 filed Jan. 10, 2007, the contents of which are hereby incorporated by reference in their entirety.

TECHNICAL FIELD

The present invention relates to a control method for a rolling stand for rolling a strip which has a left side and a right side.

BACKGROUND

Control methods of this type are generally known.

When rolling strip, it may happen that the rolled strip meanders laterally—with respect to the strip running direction. Meandering of the strip generally has the consequence that the strip is unevenly rolled, as seen in the transverse direction of the strip. The uneven rolling may lead to difficulties in subsequent processing stages (in particular in downstream rolling stands). It is therefore generally attempted to roll the strip in such a way that the center line of the rolling stand and the center line of the strip—as seen in the transverse direction of the strip—coincide (central position).

It is known from JP 07 124 620 A to use suitable measured-value transducers on the left and right sides of the strip to detect the tension prevailing there respectively on the feed and exit sides and to form the difference between the respectively detected tensions on the feed and exit sides. The differences in the tensions are fed to a control device, which on the basis of the differences determines a correcting variable for a displacement of the strip. The correcting variable is output to a correcting element, by means of which the transverse positioning is corrected in the direction of the central position.

SUMMARY

The prior-art procedure does work, but there is still room for improvement.

According to various embodiments, various means can be provided by which the transverse positioning of the strip can be determined in a simple way.

According to an embodiment, in a control method for a rolling stand for rolling a strip, which has a left side and a right side, tensions prevailing on the left and right sides of the strip on the feed and exit sides are detected by means of appropriate measured-value transducers, the detected tensions are fed to a control device for the rolling stand, the control device determines on the basis of the relationship $\delta Z=ZLE+ZLA-ZRE-ZRA$ a measure of a transverse positioning of the strip in relation to the rolling stand, wherein $\delta Z$ is the measure, ZLE is the tension prevailing on the left side of the strip on the feed side, ZLA is the tension prevailing on the left side of the strip on the exit side, ZRE is the tension prevailing on the right side of the strip on the feed side and ZRA is the tension prevailing on the right side of the strip on the exit side, and wherein the control device determines on the basis of the measure for the transverse positioning of the strip a correcting variable for a correction of the transverse positioning of the strip and activates the rolling stand in accordance with the correcting variable.

According to another embodiment, in a computer program, which comprises a sequence of machine commands, wherein the sequence of machine commands can be executed by a control device for a rolling stand, the execution of the sequence of machine commands by the control device has the effect that the control device controls the rolling stand according to the above mentioned method when the control device is in operative connection with the rolling stand.

According to yet another embodiment, a data carrier comprises a computer program as described above stored on the data carrier.

According to yet another embodiment, a control device for a rolling stand, has a data carrier as described above and the computer program stored on the data carrier can be executed by the control device.

According to yet another embodiment, a rolling device comprises a rolling stand controlled by a control device, wherein a strip, which has a left side and a right side, can be rolled by means of the rolling stand, wherein the rolling stand is assigned measured-value transducers, by means of which tensions prevailing on the left and right sides of the strip on the feed and exit sides can be detected, wherein the detected tensions can be fed to the control device, wherein a measure of a transverse positioning of the strip in relation to the rolling stand can be determined by the control device on the basis of the relationship $\delta Z=ZLE+ZLA-ZRE-ZRA$, wherein $\delta Z$ is the measure, ZLE is the tension prevailing on the left side of the strip on the feed side, ZLA is the tension prevailing on the left side of the strip on the exit side, ZRE is the tension prevailing on the right side of the strip on the feed side and ZRA is the tension prevailing on the right side of the strip on the exit side, and wherein a correcting variable for a correction of the transverse positioning of the strip can be determined by the control device on the basis of the measure for the transverse positioning of the strip and the rolling stand can be activated by said control device in accordance with the correcting variable.

BRIEF DESCRIPTION OF THE DRAWINGS

Further advantages and details emerge from the following description of an exemplary embodiment in conjunction with the basic drawings, in which.

DETAILED DESCRIPTION

According to various embodiments, appropriate measured-value transducers on the left and right sides of the strip are used to detect tensions prevailing in the strip on the feed and exit sides. The detected tensions are fed to a control device for the rolling stand. The control device determines on the basis of the relationship $$\delta Z=ZLE+ZLA-ZRE-ZRA$$

a measure of a transverse positioning of the strip in relation to the rolling stand. ZLE is the tension prevailing on the left side of the strip on the feed side, ZLA is the tension prevailing on the left side of the strip on the exit side, ZRE is the tension prevailing on the right side of the strip on the feed side and ZRA is the tension prevailing on the right side of the strip on the exit side. δZ is the measure. On the basis of the measure for the transverse positioning of the strip, the control device determines a correcting variable for a correction of the transverse positioning of the strip. It activates the rolling strip in accordance with the correcting variable.

The computer program comprises a sequence of machine commands, wherein the sequence of machine commands can be executed by the control device. The execution of the sequence of machine commands by the control device has the effect that the control device controls the rolling stand according to the method described above when the control device is in operative connection with the rolling stand.

A computer program of this type is respectively stored on the data carrier and in the control device.

Figure 1:
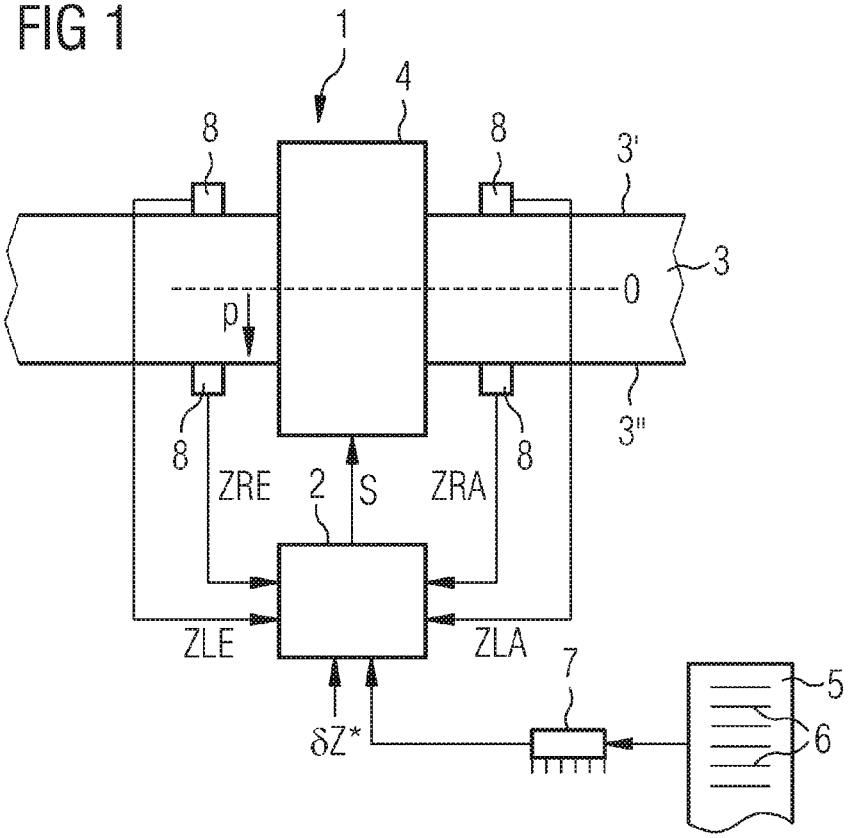
FIG. 1 schematically shows a rolling device and a strip from above.
Figure 2:
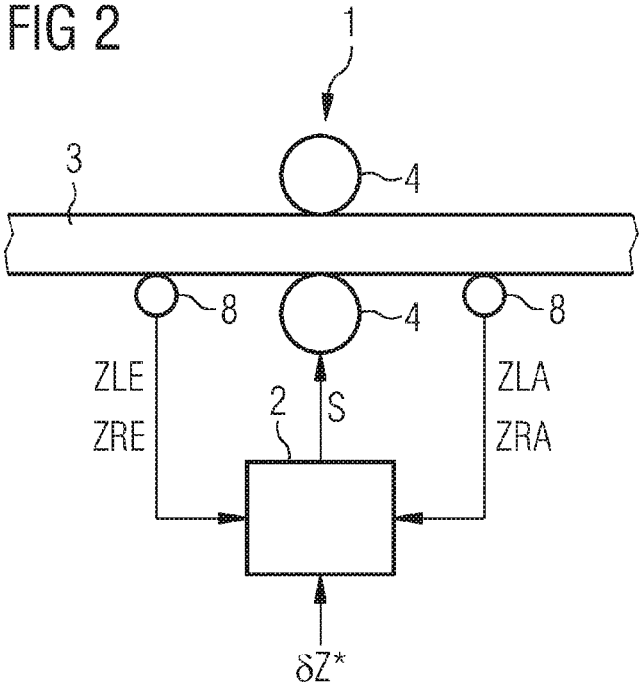
FIG. 2 schematically shows the rolling device and the strip from FIG. 1 from the side, FIG. 3 schematically shows the rolling device and the strip from FIG. 1 from above and FIG. 4 schematically shows a possible manner of determining a correcting variable.
Figure 3:
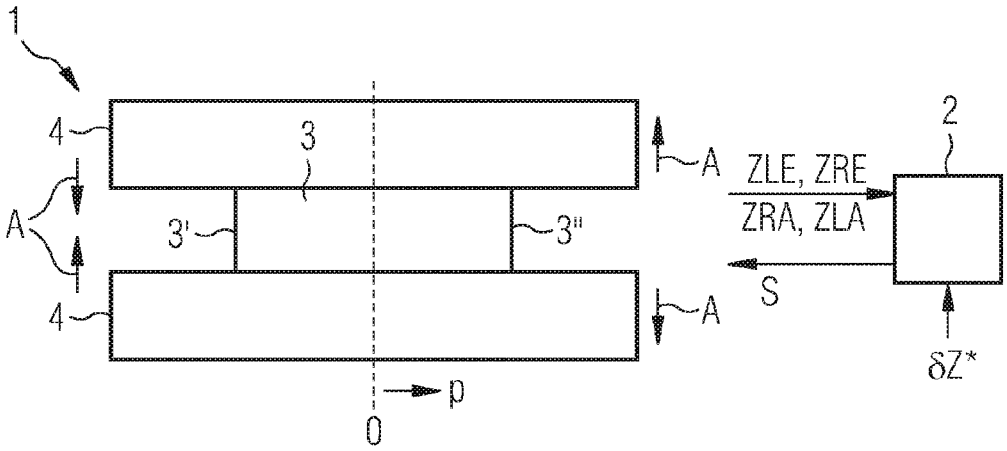

According to FIGS. 1 to 3, a rolling device has a rolling stand 1 and a control device 2 for the rolling stand 1. During operation, a strip 3 which has a left side 3' and a right side 3" is rolled by means of the rolling stand 1.

The rolling stand 1 has at least two work rolls 4. The rolling stand 1 generally has further rolls, for example when formed as a four-high stand backing rolls or when formed as a six-high stand backing rolls and intermediate rolls. Other configurations, for example as a so-called twenty-roll stand, are also possible. The further rolls are not included in the representations in the figures.

The control device 2 controls the entire operation of the rolling stand 1. For example, it controls the circumferential speed of the work rolls 4, the adjustment of the rolling stand 1, the rolling force, etc. The control of the rolling stand 1 by the control device 2 is only discussed below to the extent necessary for understanding the present invention.

The control device 2 is generally formed as a programmable control device, for example as a stored-program controller (SPC). The operating mode of the control device 2 is therefore determined by a computer program 5 with which the control device 2 is programmed.

For programming the control device 2, the computer program 5 is created. It comprises a sequence of machine commands 6. The sequence of machine commands 6 can be executed by the control device 2. The execution of the sequence of machine commands 6 by the control device 2 has the effect that the control device 2 controls the rolling stand 1 according to a control method which is explained in more detail below. For this purpose, the control device 2 must of course be in operative connection with the rolling stand 1.

The computer program 5 is stored on a data carrier 7, for example an EEPROM. The data carrier 7 is connected—at least for a time—to the control device 2 in terms of data technology. So it is possible, for example, for the control device 2 always to execute the computer program 5 that is stored on the data carrier 7 when it carries out its control method. In this case, the data carrier 7 must be connected to the control device 2 while it is carrying out the control method. Alternatively, it is possible for the control device 2 to have its own internal memory that is not represented in FIG. 1 (=internal data carrier), in which it stores the computer program 5 after reading it out from the data carrier 7 that is represented in FIG. 1. In this case, the data carrier 7 only has to be connected to the control device 2 temporarily. Alternatively, it is in turn possible for the computer program 5 to be fed to the control device 2 via a network link that is not represented. In this case, only the internal data carrier of the control device 2 is required.

In the course of processing the computer program 5, the control device 2 activates measured-value transducers 8, which are assigned to the rolling stand 1. Tensions ZLE, ZLA, ZRE, ZRA, which prevail on the left and right sides 3', 3" of the strip 3 on the feed and exit sides, are detected by means of the measured-value transducers 8. ZLE denotes the tension prevailing on the left side 3' of the strip 3 on the feed side. ZLA denotes the tension prevailing on the left side 3' of the strip 3 on the exit side. ZRE denotes the tension prevailing on the right side 3" of the strip 3 on the feed side. ZRA denotes the tension prevailing on the right side 3" of the strip 3 on the exit side.

The actual configuration of the measured-value transducers 8 can be chosen according to requirements. For example, the measured-value transducers 8 may be grouped together on the one hand on the feed side and on the other hand on the exit side to form in each case a segmented tension-measuring roller. However, other configurations are alternatively also conceivable and possible.

Figure 4:
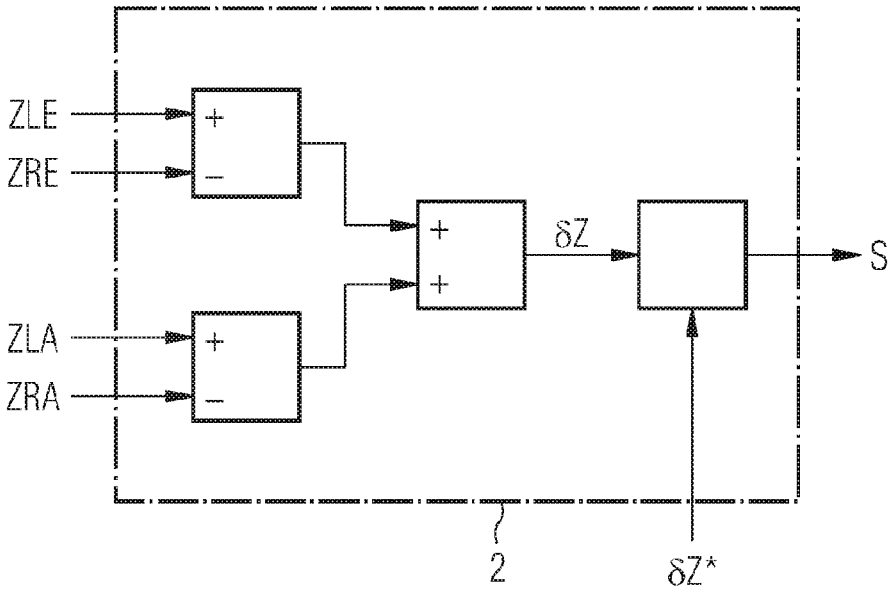

The detected tensions ZLE, ZLA, ZRE, ZRA are fed to the control device 2. The control device 2 determines on the basis of the detected tensions ZLE, ZLA, ZRE, ZRA a measure δZ of a transverse positioning p of the strip 3 in relation to the rolling stand 1. In particular—see FIG. 4—the control device 2 determines the measure δZ on the basis of the relationship $$\delta Z = ZLE + ZLA - ZRE - ZRA.$$

On the basis of the measure δZ—possibly in conjunction with a desired measure δZ*—the control device 2 determines a correcting variable S. The correcting variable S is output to the rolling stand 1. The rolling stand 1 is therefore activated in accordance with the correcting variable S.

The correcting variable S brings about a correction of the transverse positioning p of the strip 3. It may be, for example—see the arrows A schematically indicated in FIG. 3—a wedge adjustment of the work rolls 4.

It is possible for the correcting variable S to be always dependent on the measure δZ (or the difference between the measure δZ and the desired measure δZ*). The correcting variable S may, however, also have a hysteresis—in a way similar to a two-position controller.

The above description serves exclusively for explaining the present invention. On the other hand, the scope of protection of the present invention is to be determined exclusively by the appended claims.

What is claimed is:

1. A control method for a rolling stand for rolling a strip, which has a left side and a right side, comprising:

detecting tensions prevailing on the left and right sides of the strip on the feed and exit sides by means of appropriate measured-value transducers, feeding the detected tensions to a control device for the rolling stand, determining by the control device on the basis of the relationship δZ=ZLE+ZLA−ZRE−ZRA a measure of a transverse positioning of the strip in relation to the rolling stand, wherein δZ is the measure, ZLE is the tension prevailing on the left side of the strip on the feed side, ZLA is the tension prevailing on the left side of the strip on the exit side, ZRE is the tension prevailing on the right side of the strip on the feed side and ZRA is the tension prevailing on the right side of the strip on the exit side, and determining by the control device on the basis of the measure for the transverse positioning of the strip a correcting variable for a correction of the transverse positioning of the strip and activating the rolling stand in accordance with the correcting variable.

2. The method according to claim 1, wherein the control device is programmed by an EEPROM.

3. The method according to claim 1, wherein the control device is coupled with a network link for receiving program instructions.

* * * * *